US011322322B2

(12) United States Patent
Hiza et al.

(10) Patent No.: US 11,322,322 B2
(45) Date of Patent: May 3, 2022

(54) INSULATING MOLDED BODY AND GAS CIRCUIT BREAKER

(71) Applicant: MITSUBISHI ELECTRIC CORPORATION, Chiyoda-ku (JP)

(72) Inventors: Shuichi Hiza, Chiyoda-ku (JP); Takashi Kawana, Chiyoda-ku (JP); Fumihiko Hosokoshi, Chiyoda-ku (JP); Motohiro Sato, Chiyoda-ku (JP); Kenji Mimura, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 16/962,691

(22) PCT Filed: Oct. 30, 2018

(86) PCT No.: PCT/JP2018/040325
§ 371 (c)(1),
(2) Date: Jul. 16, 2020

(87) PCT Pub. No.: WO2019/176159
PCT Pub. Date: Sep. 19, 2019

(65) Prior Publication Data

US 2020/0357587 A1 Nov. 12, 2020

(30) Foreign Application Priority Data

Mar. 12, 2018 (JP) ..... JP2018-043957

(51) Int. Cl.
*H01H 33/22* (2006.01)
*H01H 33/74* (2006.01)
*H01H 33/78* (2006.01)

(52) U.S. Cl.
CPC ..... *H01H 33/78* (2013.01); *H01H 33/74* (2013.01); *H01H 33/22* (2013.01)

(58) Field of Classification Search
CPC ..... H01H 33/78; H01H 33/74; H01H 33/70; H01H 33/22; H01H 33/7023; H01H 33/7038; H01H 33/7046; H01B 3/44
(Continued)

(56) References Cited

U.S. PATENT DOCUMENTS 4,791,256 A * 12/1988 Yonezawa ..... C08K 3/38 218/53
5,841,088 A 11/1998 Yamaguchi et al.
(Continued)

FOREIGN PATENT DOCUMENTS

JP 48-58373 8/1973
JP 57-210507 A 12/1982
(Continued)

OTHER PUBLICATIONS

International Search Report dated Jan. 8, 2019 in PCT/JP2018/040325 filed on Oct. 30, 2018, 2 pages.
(Continued)

*Primary Examiner* — William A Bolton
(74) *Attorney, Agent, or Firm* — Xsensus LLP

(57) ABSTRACT

An insulating molded body to be used for an arc extinguishing device of a gas circuit breaker is provided. The insulating molded body includes a fluororesin mixture which contains a fluororesin and an oxygen generator configured to generate oxygen through thermal decomposition at 450° C. or more and 1,150° C. or less with an arc generated when a conduction current is interrupted. The oxygen generator is dispersed in the fluororesin. Also provided is a gas circuit breaker including an insulating nozzle formed of the insulating molded body.

6 Claims, 4 Drawing Sheets

(58) Field of Classification Search
USPC ..... 218/53, 62, 63, 72
See application file for complete search history.

(56) References Cited

U.S. PATENT DOCUMENTS

| | | | | |
|---|---|---|---|---|
| 5,925,863 | A * | 7/1999 | Zehnder | H01H 33/7076 218/53 |
| 9,475,906 | B2 * | 10/2016 | Kubo | C08G 77/46 |
| 2007/0119819 | A1 * | 5/2007 | Asokan | H01H 9/302 218/90 |
| 2014/0263187 | A1 | 9/2014 | Yamada et al. | |
| 2016/0115343 | A1 * | 4/2016 | Takahara | B29C 41/003 257/77 |

FOREIGN PATENT DOCUMENTS

| | | | |
|---|---|---|---|
| JP | 8-45411 | A | 2/1996 |
| JP | 8-176704 | A | 7/1996 |
| JP | 2014-179301 | A | 9/2014 |

OTHER PUBLICATIONS

Japanese Office Action drafted Apr. 2, 2019 in Japanese Patent Application No. 2019-511678, 8 pages (with English translation).

* cited by examiner

FIG. 4

| CONDITION | BASE RESIN | OXYGEN GENERATOR | | GENERATED PRESSURE (%) | INSULATION RESISTANCE VALUES (Ω) ON SURFACE OF INSULATING NOZZLE BEFORE AND AFTER TEST | |
|---|---|---|---|---|---|---|
| | | NAME OF SUBSTANCE | DECOMPOSITION TEMPERATURE (℃) | | BEFORE TEST | AFTER TEST |
| EXAMPLE 1 | TETRAFLUORO ETHYLENE | POTASSIUM PEROXIDE | 490 | 110 | $>1\times10^{15}$ | $>1\times10^{15}$ |
| EXAMPLE 2 | TETRAFLUORO ETHYLENE | SODIUM PEROXIDE | 660 | 113 | $>1\times10^{15}$ | $>1\times10^{15}$ |
| EXAMPLE 3 | TETRAFLUORO ETHYLENE | BARIUM PEROXIDE | 800 | 108 | $>1\times10^{15}$ | $>1\times10^{15}$ |
| EXAMPLE 4 | TETRAFLUORO ETHYLENE | MANGANESE DIOXIDE | 550 | 111 | $>1\times10^{15}$ | $>1\times10^{15}$ |
| EXAMPLE 5 | TETRAFLUORO ETHYLENE | COBALT(II,III) OXIDE | 900 | 105 | $>1\times10^{15}$ | $>1\times10^{15}$ |
| EXAMPLE 6 | TETRAFLUORO ETHYLENE | COPPER(II) OXIDE | 1050 | 101 | $>1\times10^{15}$ | $7\times10^{13}$ |
| COMPARATIVE EXAMPLE 1 | TETRAFLUORO ETHYLENE | NONE | - | 100 | $>1\times10^{15}$ | $3.5\times10^{12}$ |
| COMPARATIVE EXAMPLE 2 | TETRAFLUORO ETHYLENE | CALCIUM PEROXIDE | 275 | 98 | $>1\times10^{15}$ | $2.1\times10^{12}$ |
| COMPARATIVE EXAMPLE 3 | TETRAFLUORO ETHYLENE | TITANIUM OXIDE | 1860 | 93 | $>1\times10^{15}$ | $5\times10^{14}$ |
| COMPARATIVE EXAMPLE 4 | TETRAFLUORO ETHYLENE | CHROMIUM(VI) OXIDE | 250 | 98 | $>1\times10^{15}$ | $3.1\times10^{12}$ |
| COMPARATIVE EXAMPLE 5 | TETRAFLUORO ETHYLENE | IRON(III) OXIDE | 1400 | 98 | $>1\times10^{15}$ | $2.7\times10^{12}$ |

INSULATING MOLDED BODY AND GAS CIRCUIT BREAKER

TECHNICAL FIELD

The present invention relates to an insulating molded body to be used for a gas circuit breaker configured to blow an insulating gas onto an arc generated when a current is interrupted, to thereby extinguish the arc, and to a gas circuit breaker.

BACKGROUND ART

In an electric facility, a gas circuit breaker is used as a current interrupting device. The gas circuit breaker is configured to blow an insulating gas onto an arc generated between a movable contact and a fixed contact when a conduction current is interrupted, to thereby extinguish the arc. As a twist to strongly blow the insulating gas, there is given a gas circuit breaker having a structure including a heat puffer chamber configured to increase the pressure of the insulating gas to be blown through utilization of the heat of the arc or a mechanical puffer chamber configured to mechanically increase the pressure of the insulating gas to be blown. The gas circuit breaker having the above-mentioned structure is configured to blow the insulating gas onto the arc from an insulating nozzle while increasing the pressure of the insulating gas. When the insulating gas is blown, the heat between the movable contact and the fixed contact is discharged to an outside, and thus the arc can be efficiently extinguished.

As the insulating nozzle configured to blow the insulating gas onto the arc, there is given an insulating nozzle formed of a fluororesin excellent in heat resistance. However, when the insulating nozzle formed of a fluororesin is exposed to the arc, arc light penetrates also the inside of the fluororesin, and decomposes the inside of the fluororesin as well as the surface thereof. Therefore, carbon contained in the fluororesins is generated. The generated carbon is deposited on the surface of the insulating nozzle to decrease insulating performance on the surface of the insulating nozzle. In order to prevent the foregoing, there is disclosed an insulating nozzle in which titanium oxide is added to a resin forming the insulating nozzle. The added titanium oxide reflects arc light to suppress the decomposition of the inside of the insulating nozzle, to thereby reduce the amount of carbon to be generated. With this, the deposition of carbon on the surface is suppressed, to thereby suppress a decrease in insulating performance.

CITATION LIST

Patent Literature

[PTL 1] JP 57-210507 A

SUMMARY OF INVENTION

Technical Problem

However, in the above-mentioned related art, titanium oxide suppresses the decomposition of the surface of the insulating nozzle, and hence the amount of a gas generated from the fluororesin forming the insulating nozzle is reduced. Therefore, there is a problem in that the pressure for blowing the insulating gas is decreased, and arc extinguishing performance is decreased. As a result, it has been difficult to achieve both the improvement of the arc extinguishing performance and the suppression of a decrease in insulating performance of the insulating nozzle.

The present invention has been made in order to solve the above-mentioned problem. Specifically, an object of the present invention is to provide an insulating molded body and a gas circuit breaker, which can improve arc extinguishing performance and suppress a decrease in insulating performance.

Solution to Problem

According to one embodiment of the present invention, there is provided an insulating molded body to be used for an arc extinguishing device of a gas circuit breaker, the insulating molded body including a fluororesin mixture which contains a fluororesin and an oxygen generator configured to generate oxygen through thermal decomposition at 450° C. or more and 1,150° C. or less with an arc generated when a conduction current is interrupted, and in which the oxygen generator is dispersed in the fluororesin.

Advantageous Effects of Invention

The insulating molded body for arc extinguishing of the present invention includes the fluororesin mixture which contains the fluororesin and the oxygen generator configured to generate oxygen through thermal decomposition at 450° C. or more and 1,150° C. or less, and in which the oxygen generator is dispersed in the fluororesin. With this, the arc extinguishing performance and the durability of the insulating performance of an insulating nozzle are improved.

BRIEF DESCRIPTION OF DRAWINGS

FIG. 4 is a table showing experimental results of the gas circuit breaker according to the first embodiment of the present invention.

DESCRIPTION OF EMBODIMENTS

First Embodiment

Figure 1:
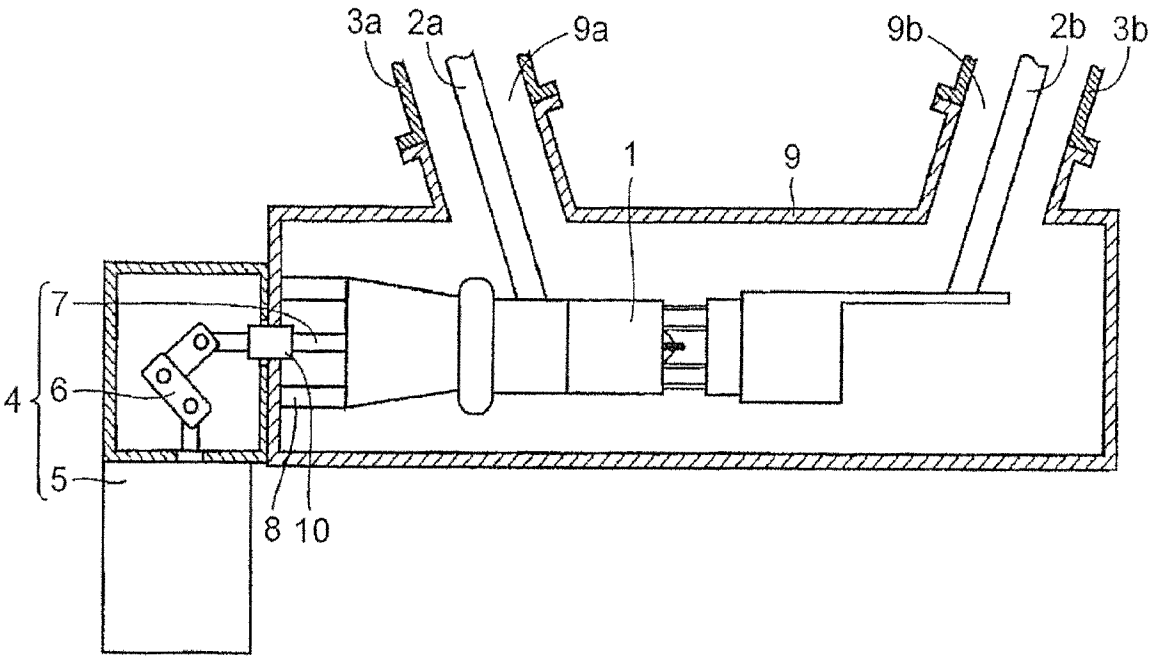
FIG. 1 is a side view of a gas circuit breaker according to a first embodiment of the present invention in which a housing is illustrated in cross section.

FIG. 1 is a side view of a gas circuit breaker according to a first embodiment of the present invention.

In FIG. 1, a housing 9 is illustrated in cross section so that an internal structure of the gas circuit breaker is understood.

The gas circuit breaker according to this embodiment includes: an arc extinguishing device 1 configured to conduct or interrupt a current; a first conductor 2*a* and a second conductor 2*b* each connected to the arc extinguishing device 1; an actuating mechanism 4 coupled to the arc extinguishing device 1 and configured to generate a driving force; the housing 9 configured to accommodate the arc extinguishing device 1 in the inside thereof; an insulating support 8 configured to support the arc extinguishing device 1 in the housing 9; and a sliding member 10 mounted to the housing 9. In addition, the housing 9 is filled with an insulating gas. The arc extinguishing device 1 is also filled with the insulating gas.

One end portions of the first conductor 2*a* and the second conductor 2*b* are each connected to the arc extinguishing device 1. In addition, the other end portions of the first conductor 2*a* and the second conductor 2*b* are each connected to another device or the like (not shown).

The actuating mechanism 4 includes a driving device 5, a transmission device 6, and a coupling device 7. The actuating mechanism 4 is configured to generate a driving force and transmit the driving force to the arc extinguishing device 1, to thereby drive the arc extinguishing device 1.

The driving device 5 has a spring mechanism including a spring. The driving device 5 is a device that utilizes a biasing force of the spring as a driving force. The driving device 5 includes a retaining device configured to retain the spring and a switching device configured to switch between an accumulation state and a release state of the biasing force of the spring. As another form of the driving device 5, a hydraulic mechanism including a hydraulic pump or an electric mechanism including a motor may be used.

The transmission device 6 is a link member formed into a V shape. The transmission device 6 is supported so as to be rotatable about a central bent portion. One end portion of the transmission device 6 is coupled to the driving device 5. In addition, the other end portion of the transmission device 6 is coupled to the coupling device 7. The transmission device 6 is configured to transmit the driving force generated by the driving device 5 to the coupling device 7.

The coupling device 7 is a bar-like link member. The other end portion of the transmission device 6 is coupled to one end portion of the coupling device 7. With this, the driving force is transmitted from the transmission device 6 to the coupling device 7. The other end portion of the coupling device 7 is coupled to the arc extinguishing device 1, and the driving force is transmitted from the coupling device 7 to the arc extinguishing device 1.

The housing 9 is configured such that the housing 9 includes a plurality of walls. The arc extinguishing device 1 is supported by a plurality of insulating supports 8 in the housing 9. One wall of the housing 9 includes a first opening portion 9*a* and a second opening portion 9*b*. The first opening portion 9*a* and the second opening portion 9*b* are connected to a bushing 3*a* and a bushing 3*b*, respectively, so that leakage of the insulating gas in the housing 9 is prevented. The first conductor 2*a* extends through the first opening portion 9*a* and the bushing 3*a*. In addition, the second conductor 2*b* extends through the second opening portion 9*b* and the bushing 3*b*.

In addition, the sliding member 10 having a tubular shape is mounted to another wall of the housing 9 on a side brought into contact with the actuating mechanism 4. The coupling device 7 penetrates through the sliding member 10. An O-ring is provided on an inner peripheral surface of the sliding member 10, and the coupling device 7 penetrates through the O-ring. With the O-ring, the coupling device 7 can slide inside the sliding member 10 while keeping such airtightness that leakage of the insulating gas in the housing 9 is prevented.

As the insulating gas with which the housing 9 is filled, sulfur hexafluoride ($SF_6$), carbon dioxide ($CO_2$), trifluoromethane iodide ($CF_3I$), nitrogen ($N_2$), oxygen ($O_2$), tetrafluoromethane ($CF_4$), argon (Ar), helium (He), or a mixture of at least two of these gases is used. The filling gas is preferably sulfur hexafluoride ($SF_6$) having a high insulating property and high heat conductivity. Sulfur hexafluoride ($SF_6$) is used alone or as a mixture with carbon dioxide ($CO_2$) or nitrogen ($N_2$).

Figure 2:
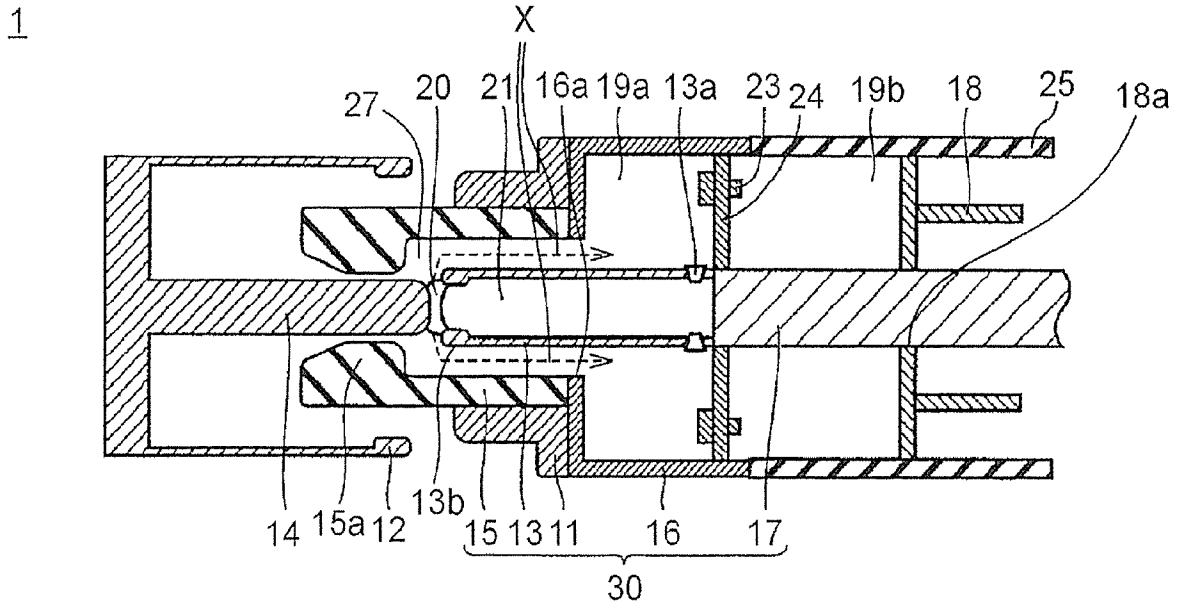
FIG. 2 is a sectional view for illustrating a main part of the gas circuit breaker in a first half of opening.
Figure 3:
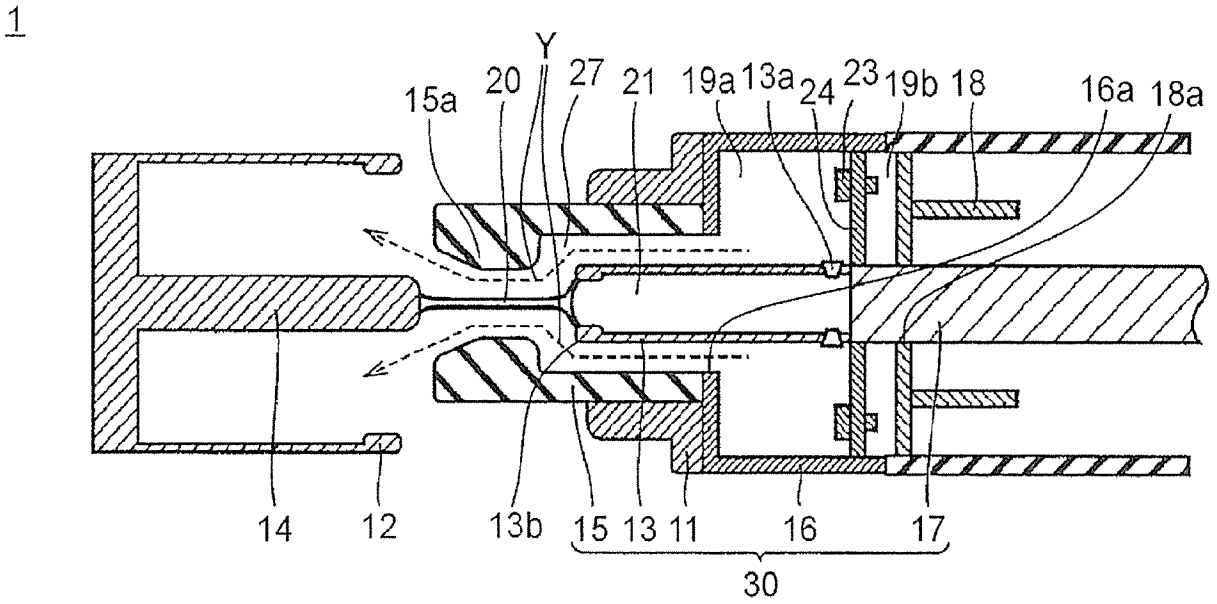
FIG. 3 is a sectional view for illustrating the main part of the gas circuit breaker in a second half of opening.

FIG. 2 and FIG. 3 are each a sectional view for illustrating a main part of the gas circuit breaker. FIG. 2 is a view for illustrating the state of the gas circuit breaker in a first half of opening. FIG. 3 is a view for illustrating the state of the same part as in FIG. 2 in a second half of opening.

The arc extinguishing device 1 includes a fixed energizing contact 12 and a fixed arc contact 14. The fixed energizing contact 12 and the fixed arc contact 14 are integrally formed of a conductive material, and are fixed to the housing 9 by a method not shown in the figures.

The fixed energizing contact 12 is a bottomed cylindrical member having one end portion opened. On an inner surface of the opening portion of the bottomed cylindrical member, a protrusion is formed over an entire circumference.

The fixed arc contact 14 is a bar-like member arranged on an inner side of the fixed energizing contact 12. One end portion of the fixed arc contact 14 is fixed to the center of a bottom of the fixed energizing contact 12.

The arc extinguishing device 1 further includes an operation rod 17, a movable arc contact 13, a partition wall 24, a puffer cylinder 16, a movable energizing contact 11, an insulating nozzle 15, and a piston cylinder 25. Those members constitute a movable part 30. In addition, a piston 18 is fixed to the housing 9 by a method not shown in the figures.

The operation rod 17 is a bar-like member formed of a conductive material. One end portion of the operation rod 17 is fixed to the coupling device 7. The operation rod 17 is configured to receive the driving force from the coupling device 7.

The movable arc contact 13 is a hollow tubular member having both end portions opened and having a space 21 therein. The movable arc contact 13 is formed of a conductive material. An end surface of one end portion of the movable arc contact 13 is fixed to an end surface of the other end portion of the operation rod 17. On an inner side of the other end portion of the movable arc contact 13, an annular protrusion 13*b* is formed over an entire circumference. The annular protrusion 13*b* of the movable arc contact 13 is brought into contact with the fixed arc contact 14 when the arc extinguishing device 1 is closed. A ventilation port 13*a* is formed in the one end portion of the movable arc contact 13. During transition to closing and during transition to opening, the movable arc contact 13 moves with respect to the fixed arc contact 14 while the annular protrusion 13*b* is brought into contact with the fixed arc contact 14. In this case, the insulating gas enters and exits through the ventilation port 13*a* in accordance with a change in volume of the space 21.

The partition wall 24 is a disc-like member. An outer peripheral surface of the other end portion of the operation rod 17 penetrates through a through hole formed at the center of the partition wall 24. The partition wall 24 and the operation rod 17 are fixed to each other. In addition, the partition wall 24 is provided with a plurality of check valves 23. The plurality of check valves 23 are each configured to allow a flow of the insulating gas in one direction from a mechanical puffer chamber 19*b* to a heat puffer chamber 19*a*.

The puffer cylinder 16 is a hollow bottomed cylindrical member having one end portion opened. The partition wall 24 is fitted and fixed to the opening portion of the cylindrical member. An opening 16*a* having a circular shape is formed at the center of a bottom of the cylindrical member. The movable arc contact 13 having an outer diameter smaller than an inner diameter of the opening 16*a* is inserted in the opening 16*a* to be arranged. The puffer cylinder 16 and the partition wall 24 form the heat puffer chamber 19*a*.

The movable energizing contact 11 is a hollow tubular member having a constant inner diameter. The movable energizing contact 11 has a large-diameter portion and a small-diameter portion. The inner diameter of the movable energizing contact 11 is larger than the inner diameter of the opening 16*a* of the puffer cylinder 16. An end surface of the large-diameter portion of the movable energizing contact 11 is coaxially fixed to the bottom of the puffer cylinder 16. An outer peripheral surface of the small-diameter portion of the movable energizing contact 11 is brought into contact with the protrusion of the fixed energizing contact 12 when the arc extinguishing device 1 is closed. The movable energizing contact 11 is formed of a conductive material.

The insulating nozzle 15 is a hollow cylindrical member having a constant outer diameter. The insulating nozzle 15 is fitted to an inner peripheral surface of the movable energizing contact 11. An end surface of one end portion of the insulating nozzle 15 is coaxially fixed to the bottom of the puffer cylinder 16. On an inner peripheral surface of the other end portion of the insulating nozzle 15, an annular protrusion 15*a* that protrudes radially inward along the entire circumference of the inner peripheral surface is formed integrally with the cylindrical member. An inner diameter on one end portion side of the annular protrusion 15*a* is constant. An inner diameter on the other end portion side of the annular protrusion 15*a* is formed in such a tapered manner that the inner diameter gradually increases from the inner diameter on the one end portion side toward a distal end of the other end portion. The inner diameter of the insulating nozzle 15 and the inner diameter of the opening 16*a* of the puffer cylinder 16 are the same. That is, an inner peripheral surface of the insulating nozzle 15 fixed to the bottom of the puffer cylinder 16 and the inner peripheral surface of the opening 16*a* of the puffer cylinder 16 are formed so as to be flush with each other.

The insulating nozzle 15 is configured to enclose a half of the movable arc contact 13 on the other end side that is a distal end side. An annular gap 27 is formed between an outer peripheral surface of the other end portion of the movable arc contact 13 and the inner peripheral surface of the one end portion of the insulating nozzle 15. The annular gap 27 serves as a flow passage through which the insulating gas flows in accordance with the progress of an opening operation of the arc extinguishing device 1. In the annular gap 27, in the first half of the opening operation of the arc extinguishing device 1, the insulating gas flows from the other end portion of the movable arc contact 13 to the heat puffer chamber 19*a* as indicated by the broken line arrow X of FIG. 2. In addition, in the second half of the opening operation of the arc extinguishing device 1, the insulating gas blows out from the heat puffer chamber 19*a* toward the other end portion of the movable arc contact 13 as indicated by the broken line arrow Y of FIG. 3.

The insulating nozzle 15 is an insulating molded body formed of a fluororesin mixture containing a fluororesin excellent in heat resistance and an oxygen generator. A tetrafluoroethylene resin is used as the fluororesin forming the insulating nozzle 15. As the fluororesin other than the foregoing, any one of a tetrafluoroethylene-hexafluoropropylene copolymer resin and a tetrafluoroethylene-perfluoroalkyl ether copolymer resin may be used.

As the oxygen generator to be blended with the fluororesin, an inorganic peroxide having a thermal decomposition temperature within a range of 450° C. or more and 1,150° C. or less is used. As the inorganic peroxide, at least any one of potassium peroxide, sodium peroxide, or barium peroxide is used. As the oxygen generator to be blended with the fluororesin, an inorganic oxide having a thermal decomposition temperature within a range of 450° C. or more and 1,150° C. or less may also be used. As the inorganic oxide, at least any one of manganese dioxide, cobalt(II,III) oxide, or copper(II) oxide is used. When an arc is generated, the fluororesin is decomposed to generate carbon. The generated carbon is deposited on the surface of the insulating nozzle 15 to decrease the insulating performance of the insulating nozzle 15. In contrast, in the insulating nozzle 15 according to this embodiment in which the oxygen generator is blended with the fluororesin, oxygen generated from the oxygen generator is combined with the carbon generated from the fluororesin to form carbon dioxide or carbon monoxide. Thus, the deposition of the carbon generated from the fluororesin on the surface of the insulating nozzle 15 is suppressed, and a decrease in insulating performance of the insulating nozzle 15 can be suppressed.

As the mechanism in which oxygen is generated from the oxygen generator, a thermal decomposition reaction of the oxygen generator caused by heat of the arc generated when a conduction current is interrupted is utilized. The oxygen generator generates oxygen, for example, based on the following reaction formula.

$$2MnO_2 \rightarrow 2MnO + O_2$$

The oxygen generator is dispersed in the fluororesin. With this, oxygen can be generated in the vicinity of the carbon deposited on the surface of the insulating nozzle 15. Therefore, oxygen can be efficiently combined with the carbon deposited on the surface of the insulating nozzle 15.

When an oxygen generator having a thermal decomposition temperature of less than 450° C. is used, the thermal decomposition reaction proceeds through heating during a molding step of the fluororesin. As a result, the function of the oxygen generator in the arc extinguishing device 1 is impaired, and the deposition of the generated carbon on the surface of the insulating nozzle 15 cannot be suppressed. The molding temperature of the fluororesin varies depending on the kind of the fluororesin, and is 400° C. at maximum. During a heating step, the molded body is increased in temperature up to a certain temperature, but there is a risk in that the temperature of the molded body may become higher than the certain temperature owing to variation in heating. Therefore, it is preferred that the oxygen generator having a thermal decomposition temperature of 450° C. or more be used in consideration of 50° C. corresponding to the variation. The thermal decomposition temperatures of potassium peroxide, sodium peroxide, barium peroxide, manganese dioxide, cobalt(II,III) oxide, and copper(II) oxide, which each serve as a material that may be used as the oxygen generator in the present invention, are 490° C., 660° C., 800° C., 550° C., 900° C., and 1,050° C., respectively.

In addition, in the case where an oxygen generator having a thermal decomposition temperature of more than 1,150° C. is used, even through exposure to an arc generated when the arc extinguishing device 1 is opened, that is, when a conduction current is interrupted, the thermal decomposition reaction of the oxygen generator does not sufficiently proceed, and hence the generation amount of oxygen is not sufficient. Therefore, the amount of oxygen to be combined with the carbon generated from the fluororesin is not sufficient, and hence carbon deposition cannot be sufficiently suppressed. The blending amount of the oxygen generator may be increased in order to increase the generation amount of oxygen. However, the increase in blending amount of the oxygen generator causes a decrease in blending amount of the fluororesin serving as a main material, with the result that the durability and the mechanical strength of the insulating nozzle 15 are decreased. That is, in order to generate oxygen sufficient for the generated carbon, it is preferred that the oxygen generator be sufficiently thermally decomposed within a temperature range which the oxygen generator can reach when exposed to the arc. Therefore, it is preferred that the oxygen generator having a thermal decomposition temperature of 1,150° C. or less be used.

The addition amount of the oxygen generator is desirably 0.5 wt % or more and less than 50 wt % with respect to the fluororesin mixture. When the addition amount of the oxygen generator is 0.5 wt % or more, a required amount of oxygen can be obtained. In addition, when the addition amount of the oxygen generator is less than 50 wt %, a sufficient amount of a gas is generated from the fluororesin mixed in the fluororesin mixture, and the mechanical strength of the insulating nozzle 15 is also obtained.

A wear inhibitor may be added to the fluororesin mixture forming the insulating nozzle 15 of the present invention as long as the effects of the invention are not impaired. White inorganic fine particles are used as the wear inhibitor. Specifically, the wear inhibitor is titanium oxide, boron nitride, alumina, or silica. Any of those is added. The wear inhibitor prevents arc light from penetrating the inside of the insulating nozzle 15 to prevent excessive wear of the insulating nozzle 15. The standard blending amount of the wear inhibitor is 10 wt % or less.

The piston cylinder 25 is a hollow cylindrical member. An inner diameter and an outer diameter of the piston cylinder 25 are the same as an inner diameter and an outer diameter of the puffer cylinder 16, which similarly has a cylindrical shape. An end portion of the piston cylinder 25 is connected to the end portion of the puffer cylinder 16 on an opening side. Therefore, the piston cylinder 25 and the puffer cylinder 16 are connected to each other in such a manner that outer peripheral surfaces of these components are flush with each other and inner peripheral surfaces of these components are flush with each other.

The piston 18 having an outer diameter equal to the inner diameter of the piston cylinder 25 is slidably fitted to an inside of the piston cylinder 25. The piston 18 is fixed to the housing 9 by a method not shown in the figures. A sliding hole 18*a* through which the operation rod 17 penetrates is formed in a center portion of the piston 18. With such a configuration, the operation rod 17 and the piston cylinder 25 are slidably reciprocated. The piston cylinder 25, the piston 18, and the partition wall 24 form the mechanical puffer chamber 19*b*.

Now, an operation of the arc extinguishing device 1 is described.

When the arc extinguishing device 1 is closed (not shown), the movable part 30 is located at a position close to the fixed energizing contact 12 and the fixed arc contact 14. At this position, the fixed arc contact 14 is accommodated on an inner side of the annular protrusion 15*a* of the insulating nozzle 15. The outer peripheral surface of the small-diameter portion of the movable energizing contact 11 is brought into contact with the fixed energizing contact 12. In addition, a distal end portion of the fixed arc contact 14 is in abutment with the annular protrusion 13*b* of the movable arc contact 13. The driving device 5 has not output a driving force. In this state, a current flows between the fixed energizing contact 12 and the movable energizing contact 11. An arc 20 has not been generated, and hence the heat puffer chamber 19*a* has a normal pressure. In addition, no driving force has been transmitted to the partition wall 24, and hence the mechanical puffer chamber 19*b* also has a normal pressure.

FIG. 2 is a sectional view of a main part of the arc extinguishing device 1 in a former period of the opening operation of the arc extinguishing device 1. When the arc extinguishing device 1 starts to be opened, the movable part 30 is pulled by the coupling device 7 driven by the driving device 5, and the annular protrusion 13*b* of the movable arc contact 13 is separated from the fixed arc contact 14. Along with this, the arc 20 is generated between the annular protrusion 13*b* and the fixed arc contact 14. The arc 20 has high temperature, and hence the insulating gas heated with the arc 20 has high temperature. In addition, the fluororesin of the insulating nozzle 15 exposed to the arc 20 is decomposed to generate a high-temperature gas. Then, as indicated by the broken line arrow X in the figure, the insulating gas having high temperature and the generated high-temperature gas pass through the annular gap 27 formed by the insulating nozzle 15 and the movable arc contact 13 to flow into the heat puffer chamber 19*a*. When the pressure is increased with the high-temperature gas thus flowed, the insulating gas in the heat puffer chamber 19*a* blows out toward the insulating nozzle 15.

When the gas is generated from the insulating nozzle 15, the oxygen generator blended in the insulating nozzle 15 is decomposed to generate oxygen. Oxygen generated from the oxygen generator is combined with carbon generated from the fluororesin to form carbon dioxide or carbon monoxide. As the movable arc contact 13 moves to the right in the figure, the partition wall 24 and the piston cylinder 25 also move together with the movable part 30. However, the amount of movement is small in the former period of the opening operation. Therefore, the volume of the mechanical puffer chamber 19*b* is hardly changed, and the pressure in the mechanical puffer chamber 19*b* is slightly increased. As a result, the insulating gas does not blow out from the mechanical puffer chamber 19*b*.

FIG. 3 is a sectional view of the same part as in FIG. 2 in a latter period of the opening operation of the arc extinguishing device 1.

In the latter period of the opening operation of the arc extinguishing device 1, the movable part 30 moves, and the annular protrusion 13*b* moves to a position further away from the fixed arc contact 14. The arc 20 extends as the annular protrusion 13*b* is separated from the fixed arc contact 14, and gradually becomes thinner. When the movable arc contact 13 moves to the right in the figure, the partition wall 24 and the piston cylinder 25 also move together with the movable part 30, but the piston 18, which is fixed to the housing 9, does not move. Accordingly, the volume of the mechanical puffer chamber 19*b* formed by the partition wall 24, the piston cylinder 25, and the piston 18 is decreased as compared to that at the start of the opening operation. Therefore, the pressure in the mechanical puffer chamber 19*b* is increased, and the insulating gas in the mechanical puffer chamber 19*b* is pushed out. The insulating gas in the mechanical puffer chamber 19*b* passes through the check valves 23, the heat puffer chamber 19*a*, and the annular gap 27, as indicated by the broken line arrow Y in the figure, and is pushed out toward a nozzle opening portion, that is, the annular protrusion 15*a* of the insulating nozzle 15 that extends in a tapered manner.

As described above, while the insulating gas is blown onto the arc 20 to efficiently discharge the heat between the movable arc contact 13 and the fixed arc contact 14 to an outside, the arc is extinguished. Simultaneously with this, the movable energizing contact 11 and the fixed energizing contact 12 are separated by a sufficient distance at which an arc is not generated by a transient recovery voltage applied between the movable energizing contact 11 and the fixed energizing contact 12 to provide a completely insulated state. Thus, interruption of a current is completed.

EXAMPLES

The present invention is described by way of Examples below. The present invention is not limited to these Examples.

Based on the first embodiment described above, Examples 1 to 6 of the insulating nozzle 15 were produced. Specifically, as a fluororesin to be used for a fluororesin mixture, a tetrafluoroethylene resin was used in all of Examples 1 to 6. In addition, as an oxygen generator, potassium peroxide, sodium peroxide, barium peroxide, manganese dioxide, cobalt(II,III) oxide, and copper(II) oxide were individually used, and defined as Example 1, Example 2, Example 3, Example 4, Example 5, and Example 6, respectively. The fluororesin and each of the oxygen generators described above were mixed with each other, and the mixture was subjected to compression molding, followed by heat treatment at 380° C. for 10 hours in an electric furnace, to thereby obtain the insulating nozzle 15.

In addition to Examples 1 to 6 of the present invention, Comparative Examples 1 to 5 were produced for comparison. In Comparative Example 1, the insulating nozzle 15 was produced only with the tetrafluoroethylene resin without adding the oxygen generator. In Comparative Example 2, the insulating nozzle 15 was produced by adding, as the oxygen generator, calcium peroxide having a thermal decomposition temperature of 275° C., which was lower than the molding temperature of the insulating nozzle 15, to the tetrafluoroethylene resin. In Comparative Example 3, the insulating nozzle 15 was produced by adding, as the oxygen generator, titanium oxide having a thermal decomposition temperature of 1,860° C. to the tetrafluoroethylene resin. In Comparative Example 4, the insulating nozzle 15 was produced by adding, as the oxygen generator, chromium(VI) oxide having a thermal decomposition temperature of 250° C. to the tetrafluoroethylene resin. In Comparative Example 5, the insulating nozzle 15 was produced by adding, as the oxygen generator, iron(III) oxide having a thermal decomposition temperature of 1,400° C. to the tetrafluoroethylene resin. In Examples 1 to 6 and Comparative Examples 1 to 5, the compression molding and the heat treatment were performed by the same methods under the same conditions except for the presence or absence of addition of the oxygen generator and the kind of the added oxygen generator. In addition, in Examples 1 to 6 and Comparative Examples 1 to 5, additives other than the oxygen generator were not added.

Examples 1 to 6 and Comparative Examples 1 to 5 produced as described above were subjected to an arc exposure test under the same conditions. Each of the insulating nozzles 15 was set in a sealed chamber of a test apparatus, and the sealed chamber was filled with sulfur hexafluoride. In this state, a rated voltage of 84 kV and a conduction current as an effective value of 20 kA were applied to the insulating nozzle 15, and a movable contact was moved for an interruption time of from 10 ms to 15 ms, to thereby generate an arc. Thus, an interruption test was performed ten times.

During the above-mentioned arc exposure test, a generated gas pressure was measured with a pressure sensor. As the pressure sensor, a charge output pressure sensor 112A05 manufactured by PCB Piezotronics was used. For each of Examples or Comparative Examples, an average value of the generated gas pressure values in ten tests was calculated. After that, a ratio of the average value in each of Examples and Comparative Examples to the average value in Comparative Example 1 was determined and defined as a generated pressure. In addition, insulation resistance on the surface of the insulating nozzle 15 was measured before and after the arc exposure test, and a change in surface insulating performance caused by the arc exposure was evaluated.

FIG. 4 is a table showing the results of the arc exposure test in each of Examples and Comparative Examples. In the table, the "$>1\times10^{15}$" in the insulation resistance column means the maximum value that can be measured with a measuring instrument.

In each of Examples 1 to 6, an increase in generated pressure was observed as compared to Comparative Example 1, in which the oxygen generator was not added. The generated pressure of Example 2 was 113%, which was the highest, as compared to Comparative Example 1. The generated pressure of Example 1 was 110%, the generated pressure of Example 3 was 108%, the generated pressure of Example 4 was 111%, the generated pressure of Example 5 was 105°, and the generated pressure of Example 6 was 101°. This is because, in addition to the generated gas pressure ascribed to the thermal decomposition of the fluororesin, the generation of oxygen ascribed to the thermal decomposition of the oxygen generator contributes to the increase in pressure.

In addition, in each of Examples 1 to 5, there was no change in insulating performance before and after the test, and high insulating performance was maintained. In Example 6, the insulation resistance value was decreased after the test. However, the insulating performance was higher than that of Comparative Example 1, and improvement in insulating performance ascribed to the oxygen generator was observed. This is presumably because oxygen generated by thermal decomposition of the oxygen generator oxidized free carbon generated in the thermal decomposition process of the fluororesin, to thereby suppress the deposition of carbon on the insulating nozzle 15, with the result that a decrease in insulating property of the insulating nozzle 15 was prevented.

In Comparative Example 1, a significant decrease in insulating performance was observed after the test. In Comparative Example 1, the oxygen generator was not added, and hence it is considered that the carbon generated in the thermal decomposition process of the fluororesin was deposited on the surface of the insulating nozzle 15 to decrease an insulating property.

In Comparative Example 2 and Comparative Example 4, a significant decrease in insulating performance was observed after the test. The oxygen generator added in Comparative Example 2 and Comparative Example 4 is calcium peroxide or chromium(VI) oxide having a thermal decomposition temperature lower than the molding temperature. This is because, before the arc exposure test, calcium peroxide or chromium(VI) oxide was decomposed to lose an oxygen generation function, and had no oxidizing action on the carbon generated in the thermal decomposition process of the fluororesin. In addition, in Comparative Example 2 and Comparative Example 4, a slight decrease in generated gas pressure was confirmed as compared to Comparative Example 1. In Comparative Example 2 and Comparative Example 4, as described above, it is considered that calcium peroxide or chromium(VI) oxide added as the oxygen generator was decomposed before the arc exposure test, and the amount of the generated gas was small.

In Comparative Example 3, a significant decrease in generated pressure was confirmed as compared to Comparative Example 1. As one of the factors for this, there is given the fact that the thermal decomposition temperature of the added titanium oxide was as high as 1,860° C., and oxygen was not generated by the thermal decomposition reaction in the arc exposure test. As another factor, there is given the fact that the surface reflectance of the insulating nozzle 15 was increased due to the added titanium oxide to reduce the arc light penetrating the insulating nozzle 15. This is because the arc light penetrating the insulating nozzle 15 was reduced to decrease the thermal decomposition amount of the inside of the insulating nozzle 15, with the result that the thermal decomposition amount of the entirety of the insulating nozzle 15 was decreased. In Comparative Example 3, the insulating performance was slightly decreased after the test. This is presumably because, while oxygen was not generated by the decomposition of titanium oxide, and the deposition of the carbon generated in the thermal decomposition process of the fluororesin was not able to be suppressed, the penetration of the arc light into the insulating nozzle 15 was suppressed, and hence the generation amount of carbon was suppressed.

In Comparative Example 5, a significant decrease in insulating performance was observed after the test. The thermal decomposition temperature of iron(III) oxide added as the oxygen generator to the tetrafluoroethylene resin in Comparative Example 5 is as high as 1,400° C. As a factor for the decrease in insulating performance, there is given the fact that oxygen was not generated by the thermal decomposition reaction in the arc exposure test, and the carbon generated in the thermal decomposition process of the fluororesin was not oxidized. In addition, in Comparative Example 5, a slight decrease in generated gas pressure was confirmed as compared to Comparative Example 1. This is presumably because the added iron(III) oxide did not generate oxygen by arc exposure, and the amount of the generated gas was small, as described above.

According to the first embodiment of the present invention, the insulating nozzle 15 is formed of the fluororesin mixture which contains the fluororesin and the oxygen generator configured to generate oxygen through thermal decomposition at 450° C. or more and 1,150° C. or less, and in which the oxygen generator is dispersed in the fluororesin. With this, when the arc is generated, a high blowing pressure is obtained by the gas generated by the thermal decomposition of the fluororesin, and the arc can be efficiently extinguished. Therefore, the arc extinguishing performance of the gas circuit breaker can be improved.

In the fluororesin mixture forming the insulating nozzle 15, the oxygen generator configured to generate oxygen through thermal decomposition at 450° C. or more and 1,150° C. or less is blended. Therefore, when the arc is generated, sufficient oxygen is generated, and is combined with the carbon generated by the decomposition of the fluororesin. With this, the deposition of the carbon on the surface of the insulating nozzle 15 can be suppressed. Thus, a decrease in insulating performance of the insulating nozzle 15 can be suppressed.

The insulating nozzle 15 is formed of the fluororesin mixture which contains the fluororesin and the oxygen generator configured to generate oxygen through thermal decomposition at 450° C. or more and 1,150° C. or less, and in which the oxygen generator is dispersed in the fluororesin. Therefore, when the arc is generated, the arc can be efficiently extinguished. As a result, the separation distance between the movable arc contact and the fixed arc contact 14, which is required for maintaining an insulated state, can be shortened as compared to the related art. Thus, the arc extinguishing device 1 can be downsized.

In the first embodiment, the insulating nozzle 15 has been formed of the fluororesin mixture containing the fluororesin and the oxygen generator. As another Example, a flow guide for an insulating gas may be arranged between a movable arc portion and an insulating nozzle, and the insulating molded body may be arranged on the flow guide. Alternatively, the flow guide may be formed of the insulating molded body. Also alternatively, only part of the insulating nozzle 15 may be formed of the insulating molded body.

The embodiment and Examples of the present invention are described merely for an illustrative purpose, and by no means limit the present invention. The scope of the present invention is defined by the claims instead of the description in the above-mentioned Examples. In addition, in the present invention, the embodiment may be appropriately modified and omitted within the scope of the present invention.

REFERENCE SIGNS LIST 1 arc extinguishing device, 15 insulating nozzle.

The invention claimed is:

1. An insulating nozzle including an insulating molded body to be used for an arc extinguishing device of a gas circuit breaker, the insulating nozzle comprising a fluororesin mixture which contains a fluororesin and an oxygen generator configured to generate oxygen through thermal decomposition at 450° C. or more and 1,150° C. or less with an arc generated when a conduction current is interrupted, and in which the oxygen generator is dispersed in the fluororesin, wherein the oxygen generator is dispersed in an entirety of the insulating molded body, wherein the oxygen generator is an inorganic oxide, and wherein the inorganic oxide is at least any one of manganese dioxide, or cobalt (II, III) oxide.

2. The insulating nozzle according to claim 1, wherein:

a shape of the insulating molded body is a hollow cylinder; and an outer diameter of an entire length of the hollow cylinder is constant.

3. The insulating nozzle according to claim 1, further comprising:

an annular protrusion that protrudes radially inward along an entire circumference of a first end portion of the insulating molded body; and a second end portion of the insulating molded body being configured to attach to a movable energizing contact such that a thickness of the insulating molded body is greater at the annular protrusion than at the second end portion.

4. The insulating nozzle according to claim 3, wherein:

a thickness of a first end portion of the annular protrusion is constant; and a thickness of a second end portion of the annular protrusion gradually increases.

5. An insulating nozzle including an insulating molded body to be used for an arc extinguishing device of a gas circuit breaker, the insulating nozzle comprising a fluororesin mixture which contains a fluororesin and an oxygen generator configured to generate oxygen through thermal decomposition at 450° C. or more and 1,150° C. or less with an arc generated when a conduction current is interrupted, and in which the oxygen generator is dispersed in the fluororesin, wherein the oxygen generator is dispersed in an entirety of the insulating molded body, wherein the oxygen generator is an inorganic peroxide, wherein the inorganic peroxide is at least any one of sodium peroxide, or potassium peroxide.

6. A gas circuit breaker comprising:

an insulating nozzle including an insulating molded body to be used for an arc extinguishing device, the insulating nozzle including a fluororesin mixture which contains a fluororesin and an oxygen generator configured to generate oxygen through thermal decomposition at 450° C. or more and 1,150° C. or less with an arc generated when a conduction current is interrupted, and in which the oxygen generator is dispersed in the fluororesin, wherein the oxygen generator is dispersed in an entirety of the insulating molded body, wherein the arc extinguishing device is filled with an insulating gas, wherein the insulating gas is sulfur hexafluroride, wherein the oxygen generator is an inorganic oxide, and wherein the inorganic oxide is at least any one of manganese dioxide, or cobalt (II,III) oxide.

* * * * *